US005983466A

United States Patent [19]

Petkovsek

[11] Patent Number: 5,983,466

[45] Date of Patent: Nov. 16, 1999

[54] LEAKPROOF RESEALABLE SLIDER CLOSURE MECHANISM

[75] Inventor: Gregory L. Petkovsek, Appleton, Wis.

[73] Assignee: Reynolds Consumer Products, Inc., Appleton, Wis.

[21] Appl. No.: 09/107,977

[22] Filed: Jun. 30, 1998

[51] Int. Cl.[6] ..... A44B 19/16

[52] U.S. Cl. ..... 24/400; 24/399; 383/63

[58] Field of Search ..... 24/399, 400, 401, 24/389, 577; 383/63, 64, 65, 68, 69

[56] References Cited

U.S. PATENT DOCUMENTS 5,020,194 6/1991 Herrington et al. ..... 24/400

5,131,121 7/1992 Herrington, Jr. et al. ..... 24/400 X 5,442,837 8/1995 Morgan ..... 24/400

5,722,128 3/1998 Toney et al. ..... 24/400

*Primary Examiner*—James R. Brittain

*Assistant Examiner*—Robert J. Sandy

*Attorney, Agent, or Firm*—Alan M. Biddison

[57] ABSTRACT

A resealable closure mechanism includes a matable section, slider-parking section, first closure profile, second closure profile, and a slider. The first and second closure profiles have a base strip and an interlocking closure member. In the matable section, the interlocking closure members each extend a first length respective of their base strips sufficient to selectively engage. In the slider-parking section, the interlocking closure members are truncated relative to the first length. The slider has a second length greater than the distance of the slider-parking section.

17 Claims, 3 Drawing Sheets

LEAKPROOF RESEALABLE SLIDER CLOSURE MECHANISM

FIELD OF THE INVENTION

The present invention generally relates to closure arrangements for polymeric packages and, in particular, to resealable slider closure mechanisms for resealable packages.

BACKGROUND

Many packaging applications use resealable containers to store various types of articles and materials. These packages may be used to store and ship food products, non-food consumer goods, medical supplies, waste materials, and many other articles.

Resealable packages are convenient in that they can be closed and resealed after the initial opening to preserve the enclosed contents. The need to locate a storage container for the unused portion of the products in the package is thus avoided. As such, providing products in resealable packages appreciably enhances the marketability of those products.

Some types of resealable closure mechanisms are opened and closed using slider closure mechanisms. Typical resealable slider closure mechanism designs include a separator or plow-type structure at one end that opens the mechanism when the slider travels in one direction along the mechanism. The side walls of the slider are tapered at the opposite end so as to close the mechanism when the slider travels along the mechanism in the opposite direction. Side seals on the side of the resealable closure mechanism keep the slider from sliding off the package in either direction.

When a slider having this type of plow is moved to close the package, a side seal on the side of the package prevents the slider from traveling off the end of the package. The side seal holds the closure profile closed at the end, thus stopping the plow from moving further. However, the side seal does not allow the slider to sit tightly against the side of the package. Consequently, a passageway is formed that can allow the contents of the package to leak out. Fluids are particularly prone to leaking with this type of closure arrangement.

SUMMARY OF THE INVENTION

In one aspect of the present invention, one example embodiment involves a resealable closure mechanism for use with a polymeric package. The resealable closure mechanism includes a matable section and a slider-parking section. The slider-parking section extends for a first distance. The resealable closure mechanism also includes a first closure profile, second closure profile, and a slider. The first closure profile has a first base strip and a first interlocking closure member. The second closure profile has a second base strip and a second interlocking closure member.

The first and second interlocking closure members in the matable section extend from the first and second base strips, respectively, a first length sufficient to selectively engage. The first and second interlocking closure members in the slider-parking section are truncated relative to the first length.

The slider has a plow, a second length, and first and second walls that form a cavity for receiving a package edge. The second length is greater than the first distance of the slider-parking section. The slider slides along a package edge in one direction to cause the closure profiles to engage in the matable section. The slider slides along the package edge in the opposite direction to cause the closure profiles to disengage in the matable section. The slider rests in the slider-parking section.

According to another aspect of the present invention, another example embodiment involves a resealable package. The resealable package includes first and second panel sections joined together to form an enclosed region with side edges, a top edge, and a mouth that provides access to the enclosed region. The package also includes a closure arrangement for opening and sealing the mouth. The closure arrangement has a slider-parking section extending from the first side edge over a first distance and a matable section extending between the slider-parking section and the second side edge.

The closure arrangement includes a first closure profile, a second closure profile, and a slider. The first closure profile has a first base strip and a first interlocking closure member. The second closure profile has a second base strip and a second interlocking closure member.

The first and second interlocking closure members in the matable section extend from the first and second base strips, respectively, a first length sufficient to selectively engage. The first and second interlocking closure members in the slider-parking section are truncated relative to the first length.

The slider has a plow, a second length, and first and second walls that form a cavity for receiving a package edge. The second length is greater than the first distance of the slider-parking section. The slider slides along a package edge in one direction to cause the closure profiles to engage in the matable section. The slider slides along the package edge in the opposite direction to cause the closure profiles to disengage in the matable section. The slider rests in the slider-parking section.

According to another aspect of the present invention, another example embodiment involves a method of manufacturing a resealable package having first and second opposing panels. The method includes placing the first panel adjacent to the second panel; sealing a plurality of edges of the first panel to corresponding edges of the second panel; placing a resealable closure mechanism between an unsealed edge of the first panel and a corresponding unsealed edge of the second panel; and securing the resealable closure mechanism to the first and second panels. The resealable closure mechanism extends between a first-side edge of the package and a second side edge of the package. The resealable closure mechanism may typically be arranged as described herein.

According to another aspect of the present invention, another example embodiment involves a method of sealing a resealable closure mechanism. The method includes providing a package having first and second opposite side edges; a resealable mouth between the first and second side edges; and a zipper closure with a slider thereover for opening and resealing the mouth, the zipper closure having first and second opposed selectively interlocking profiles. The method also includes moving the slider along the mouth from the second edge to interlock the first and second profiles until reaching a distance from the first edge less than a length of the slider, and moving the slider snugly against the first edge without interlocking the first and second profiles to seal the mouth.

The above summary of the present invention is not intended to describe each illustrated embodiment or every implementation of the present invention. The figures and the detailed description that follow more particularly exemplify these embodiments.

BRIEF DESCRIPTION OF THE DRAWINGS

The invention may be more completely understood in consideration of the detailed description of various embodiments of the invention that follows in connection with the accompanying drawings in which.

Figure 1:
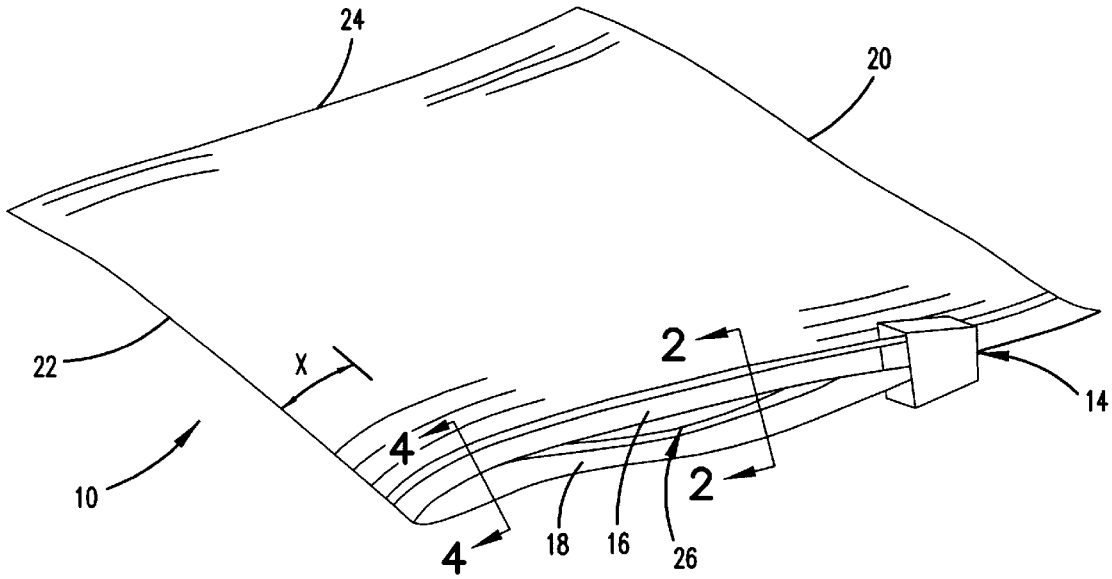
FIG. 1 is a perspective view of a flexible, resealable package according to an example embodiment of the present invention.

While the invention is amenable to various modifications and alternative forms, specifics thereof have been shown by way of example in the drawings and will be described in detail. It should be understood, however that the intention is not to limit the invention to the particular embodiments described. On the contrary, the intention is to cover all modifications, equivalents, and alternatives falling within the spirit and scope of the invention as defined by the appended claims.

DETAILED DESCRIPTION

The present invention is believed to be applicable to a variety of packaging arrangements. The invention has been found to be particularly advantageous for manufacturing resealable slider closure mechanisms. An appreciation of various aspects of the invention is best gained through a discussion of an application example for such a packaging arrangement.

According to an example embodiment of the present invention, the closure profiles are truncated at their respective bases to allow a slider to fit snugly against the side of the package. FIG. 1 illustrates an example type of package 10 that benefits from the use of such resealable slider closure mechanisms.

Attention is directed to FIG. 1. FIG. 1 illustrates an example packaging arrangement in the form of a resealable, flexible package 10 having a resealable slider closure mechanism 14 constructed in accordance with the present invention. The flexible package 10 includes first and second opposed panel sections 16, 18 made from a flexible, polymeric film. For some manufacturing applications, the first and second panel sections 16, 18 are heat-sealed together along two edges 20, 22 and meet at a fold line in order to form a three-edged containment section for a product within the interior of the package 10. The fold line comprises the bottom edge 24. Alternatively, two separate panel sections 16, 18 of polymeric film may be used and heat-sealed together along the two edges 20, 22 and at the bottom 24. Access is provided to the interior of the package 10 through a mouth 26. In other implementations the package 10 includes tear strings and/or notches at the mouth 26 to assist with opening the package 10.

A resealable slider closure mechanism 14 is illustrated in FIG. 1 at the mouth 26 of the flexible package 10. The slider closure mechanism 14 can travel the entire width of the package 10. The slider closure mechanism 14 can be one of a variety of closure mechanisms. In the particular embodiments illustrated in FIGS. 2–6, the resealable closure mechanism 14 is shown in the specific form of a resealable slider closure mechanism.

Figure 2:
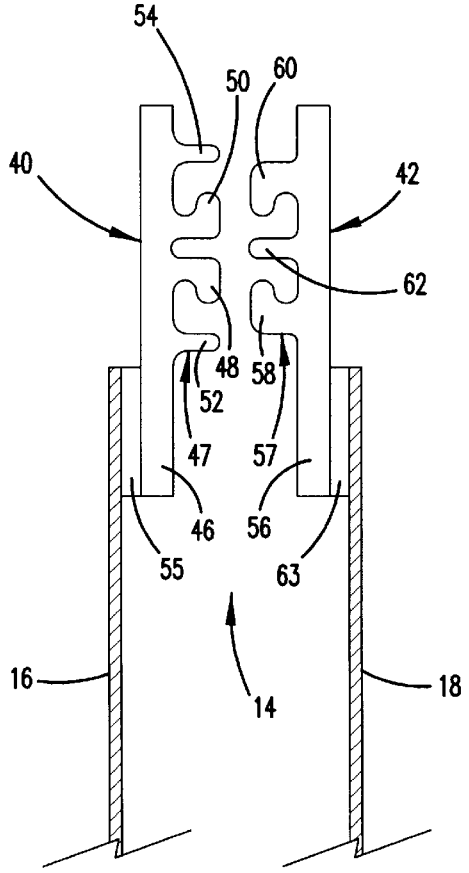
FIG. 2 is a fragmented, cross-sectional view of a resealable closure mechanism according to an example embodiment of the present invention.

Attention is directed to FIG. 2. Male and female closure profiles 40, 42 of the resealable slider closure mechanism 14 are shown in expanded form. The closure profiles 40, 42 can be one of a variety of closure profiles. In the particular embodiment illustrated, the closure mechanism 14 is shown in the specific form of a zipper-type closure mechanism. The slider closure mechanism 14 includes an elongated male closure profile 40 and an elongated female closure profile 42. Typically the closure profiles 40, 42 are manufactured separately from each other.

The male closure profile 40 is comprised of a base strip 46 and an interlocking closure member 47. The interlocking closure member 47 has two interlocking closure flanges 48, 50, two guide posts 52, 54, and a sealant layer 55. The sealant layer 55 is attached to the first package film 16 of the package 10 of FIG. 1. The base strip 46 is attached to the sealant layer 55. The interlocking closure flanges 48, 50 extend out from the base strip 46. The guide post 52, 54 also extend out from the base strip 46. The guide posts 52, 54 aid in holding the closure mechanism 14 closed and it aligning the male closure profile 40 with the female closure profile 42. Alternatively the male closure profile 40 does not have a sealant layer 55. In this implementation the base strip 46 is attached directly to the first package film 16 of the package 10 of FIG. 1. The female closure profile 42 is likewise comprised of a base strip 56 and an interlocking closure member 57. The interlocking closure member 57 has two interlocking closure flanges 58, 60, a guide post 62, and a sealant layer 63. The optional sealant layer 63 is attached to the second package film 18 of the package 10 of FIG. 1. The base strip 56 is attached to the sealant layer 63. The interlocking closure flanges 58, 60 extend out from the base strip 56. The guide post 62 also extends out from the base strip 56. The guide post 62 aids in holding the closure mechanism 14 closed and in aligning the female closure profile 42 with the male closure profile 40.

The male and female closure profiles 40,42 are designed to engage with one another to form a resealable closure mechanism 14. The interlocking closure flanges 48, 50 of the male closure profile 40 and the interlocking closure flanges 58, 60 of the female closure profile 42 extend from base strips 46, 56 respectively a sufficient distance to allow mechanical engagement therebetween. Pressure is applied to the closure profiles 40, 42 as they engage and form a resealable closure mechanism 14. Pulling the male closure profile 40 away front the female closure profile 42 causes the two closure profiles 40, 42 to disengage opening the package 10 of FIG. 1. The closure profiles 40,42 are sealed together at edges 20, 22 of FIG. 1 to further aid in aligning the closure profiles 40, 42.

In some applications, the closure profiles 40, 42 are formed by two separate extrusions or through two separate openings of the common extrusion. Typically, the resealable closure mechanism 14 is made of a flexible polymeric material, such as polyethylene or polypropylene. In one example embodiment, the closure arrangement illustrated in FIG. 2 is manufactured using conventional extrusion and heat sealing techniques. In particular, the closure profiles 40, 42 are extruded through a die plate fed by a plurality of extruders. These extruders carry the different molten materials for forming the closure profiles 40, 42. As is well known in the art, the die plate includes input ports, output ports, and channels connecting these input ports to output ports. The extruders feed the different molten materials to different input ports, and the channels are designed to configure the molten materials into the shape of the closure profiles 40, 42. Typically, the sealant layers 55, 63 are coextruded with the closure profiles 40, 42, such that the sealant layers 55, 63 are bonded to the base strip 46, 56, respectively, of the male and female closure profiles 40, 42, respectively.

Figure 3:
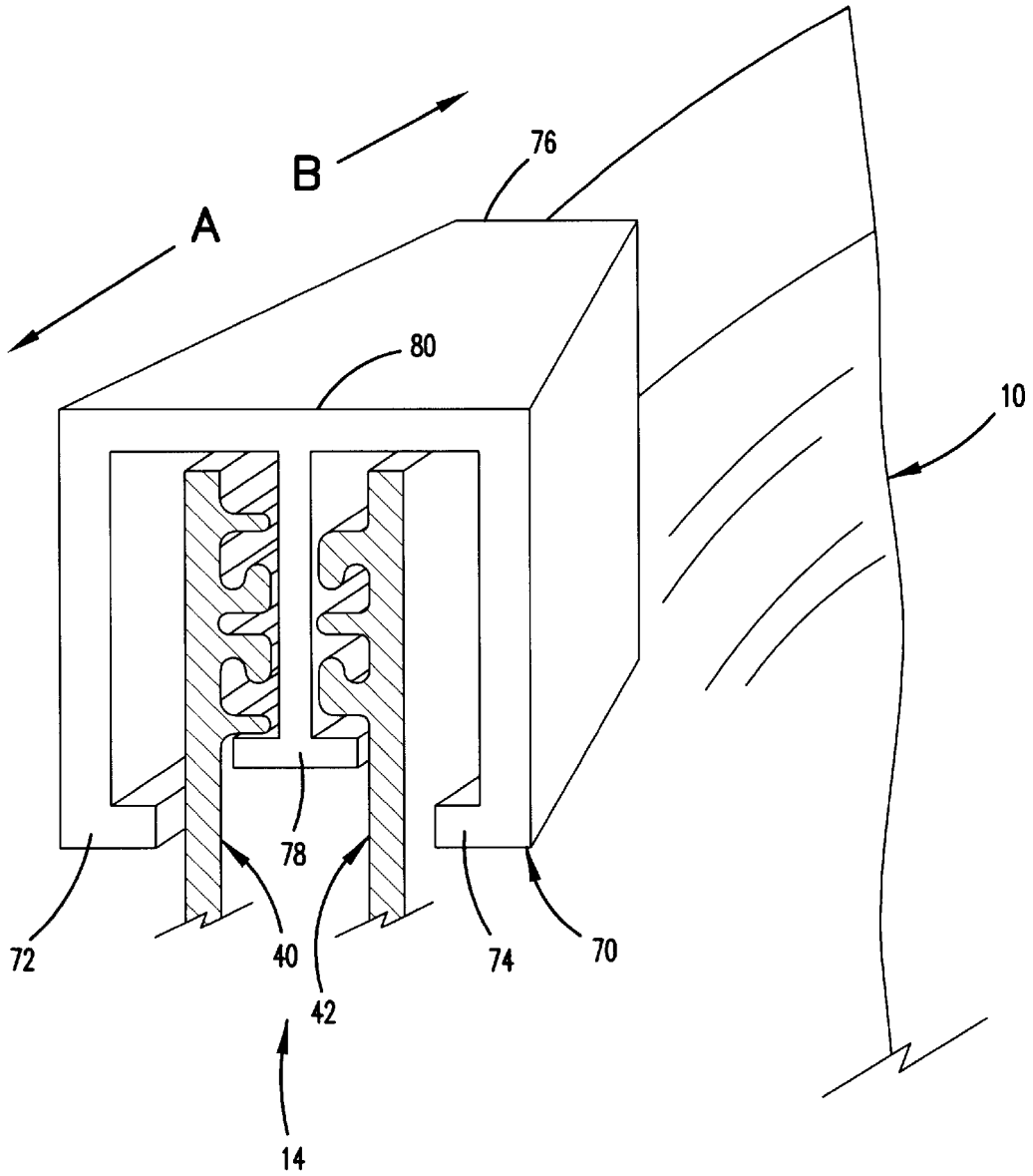
FIG. 3 is a fragmented, perspective view of a resealable slider closure mechanism according to an example embodiment of the present invention.

Attention is directed to FIG. 3. A slider 70 opens and closes the resealable closure mechanism 14. The slider 70 has side walls 72, 74 that are tapered at a first end 76 of the slider 70. The walls 72, 74 form a cavity that receives the male and female closure profiles 40, 42. The slider 70 further has a separator or plow 78 attached to it. The plow 78 generally has an upside down T-shape. The plow 78 is attached at a second end 80 of the slider 70 and extends partially through the length of the slider 70. The plow 78 does not exist at the first end 76 of the slider 70 where the walls 72, 74 are tapered. Thus, when the slider 70 is moved in a first direction A along the top edge of the package 10, the tapered shape of the side walls 72, 74 of the slider 70 applies pressure to the closure profiles 40, 42, pinching them together behind the slider 70 as the slider moves forward. Interlocking the closure profiles 40, 42 of the resealable slider closure mechanism 14 seals the package 10 preventing the contents of the package 10 from leaking out.

The plow 78 separates the closure profiles 40, 42. When the slider 78 is moved in a second direction B along the top edge of the package 10, the plow 78 forces the closure profiles 40, 42 apart, thus providing access to the contents of the package 10. The closure profiles 40, 42 are sealed together at side edges 20, 22 of FIG. 1. These side seals keep the slider 70 from sliding off of the closure profiles 40, 42 in either direction A, B.

Figure 4:
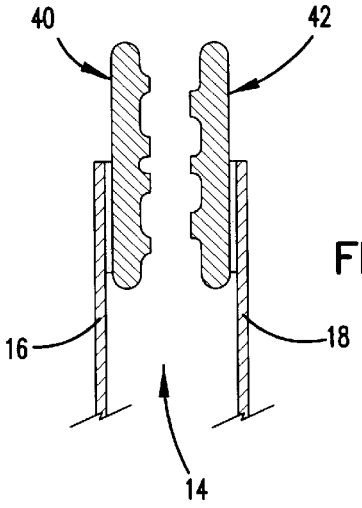
FIG. 4 is a fragmented, cross-sectional view of the resealable closure mechanism of FIG. 2 notched according to an example embodiment of the present invention.

Attention is directed to FIG. 4. The closure profiles 40, 42 are truncated at one end of the closure mechanism 14 of FIG. 1. The guide posts 52, 54 and interlocking closure flanges 48, 50 of the male closure profile 40 are truncated at their bases, reducing the thickness of the male closure profile 40. Likewise, the guide post 62 and interlocking closure flanges 58, 60 of the female closure profile 42 are truncated at their base, reducing the thickness of the female closure profile 42. Referring back to FIG. 1, the truncated closure profiles 40, 42 form a slider-parking section represented as distance X from side edge 22. This distance X is less than the length of the slider 70 of FIG. 3. Typically, X is between 1/16–3/16 in. (1.6–4.8 mm), or approximately the length "L" of the plow 78, as depicted in FIG. 3. The length of the slider 70 is between 3/8–5/8 in. (9.5–1 5.9 mm). The remaining portion, or matable section, of the closure profiles 40, 42 are not truncated and retain the shapes shown in FIG 2. Thus for the distance X, the closure profiles 40, 42 have the shapes shown in FIG 4. For the remainder of the package width, the closure profiles 40, 42 have the shapes shown in FIG. 2. Side edge 22 is the edge of the package 10 that the slider 70 rests against when the resealable slider closure mechanism 14 is in its closed position. The slider-parking section allows the slider 70 to fig snugly against the side 22 of the package 10, sealing the package 10. By "snugly," it is meant that there is not a gap between the slider 70 and the side edge 22.

Figure 5:
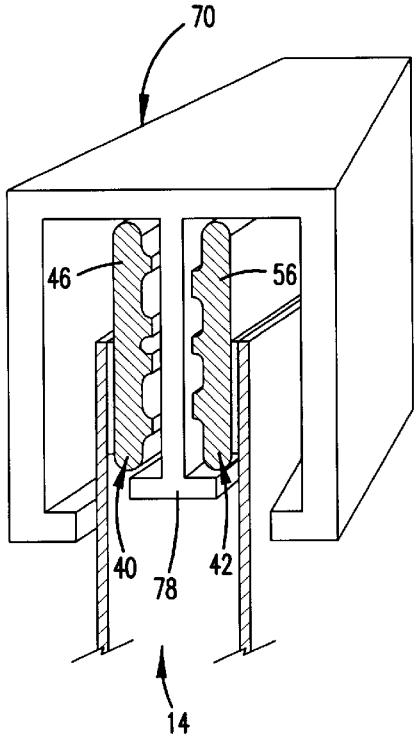
FIG. 5 is a fragmented, perspective view of a resealable slider closure mechanism according to an example embodiment of the present invention.

Attention is directed to FIG. 5. FIG. 5 illustrates the truncated closure profiles 40, 42 within the slider 70. The truncation of the closure profiles 40, 42 allows the base strips 46, 56 of the closure profiles 40, 42, respectively, to rest closer to the plow 78 of the slider 70. Because the base strips 46, 56 rest closer to the plow 78, the slider 70 is able to fit snugly against side edge 22 of the package 10 of FIG. 1. Without the truncation of the closure profiles 40, 42, the slider 70 cannot fit snugly against the side edge 22 of the package 10 of FIG. 1, because the combination of the side seal on the closure profiles 40, 42 at side edge 22 and the thickness of the closure profiles 40, 42, as shown in FIG 2, prevent the plow 78 from being able to fit snugly against the side edge 22 of FIG. 1.

Figure 6:
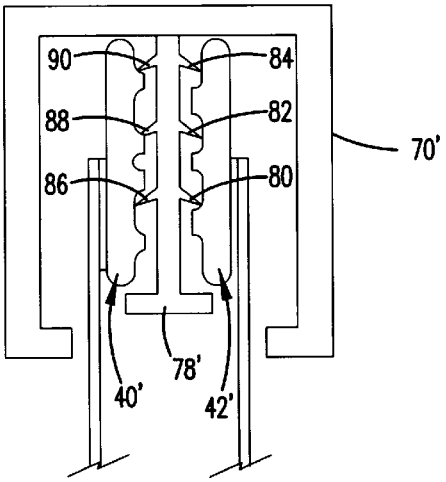
FIG. 6 is a fragmented, cross-sectional view of a resealable closure mechanism according to a second example embodiment of the present invention.

Attention is directed to FIG. 6. In another embodiment, the plow 78' of the slider 70' has a plurality of ribs 80, 82, 84, 86, 88, 90. These ribs 80, 82, 84, 86, 88, 90 help further seal the package 10 of FIG. 1. The ribs 80, 82, 84, 86, 88, 90 fit snugly against the truncated closure profiles 40', 42' sealing off the gap between the closure profiles 40', 42' and the plow 78'. This prevents materials from getting into the interior cavity of the slider 70' and possibly spilling over the closure profiles 40', 42'.

The above specification and examples are believed to provide a complete description of the manufacture and use of particular embodiments of the invention. Many embodiments of the invention can be made without departing from the spirit and scope of the invention.

I claim:

1. A resealable closure mechanism for use with a polymeric package, the resealable closure mechanism comprising:

(a) a matable section and a slider-parking section; the slider-parking section extending a first distance:

(b) a first closure profile including a first base strip and a first interlocking closure member;

(c) a second closure profile including a second base strip and a second interlocking closure member:

(i) the first and second interlocking closure members in the matable section each extending a first length from respective first and second base strips sufficient to selectively engage; and (ii) the first and second interlocking closure members in the slider-parking section being truncated relative to the first length; and (d) a slider having a plow, a second length, and first and second walls forming a first cavity for receiving a package edge; the second length being greater than the first distance of the slider-parking section; the slider being arranged and configured to:

(i) slide along a package edge in a first direction to cause the first and second closure profiles to engage in the matable section;

(ii) slide along the package edge in a second direction to cause the first and second closure profiles to disengage in the matable section; and (iii) rest in the slider-parking section.

2. A resealable closure mechanism according to claim 1, wherein the first closure profile is a male closure profile; and the second closure profile is a female closure profile.

3. A resealable closure mechanism according to claim 2, wherein the first interlocking closure member comprises first and second guide posts extending from the first base strip; and first and second interlocking closure flanges extending from the first base strip.

4. A resealable closure mechanism according to claim 3, wherein the second interlocking closure member comprises a third guide post extending from the second base strip; and third and fourth interlocking closure flanges extending from the second base strip.

5. A resealable closure mechanism according to claim 4, wherein the first closure profile further comprises a first sealant layer attached to the first base strip, and adapted to be attached to the polymeric package.

6. A resealable closure mechanism according to claim 5, wherein the second closure profile further comprises a second sealant layer attached to the second base strip, and adapted to be attached to the polymeric package.

7. A resealable closure mechanism according to claim 4, wherein the third and fourth interlocking closure flanges of the second closure profile are arranged and configured to mechanically engage with the first and second interlocking closure flanges of the first closure profile.

8. A resealable closure mechanism according to claim 1, wherein the plow includes a plurality of ribs adapted to seal the plow against the first and second closure profiles.

9. A resealable closure mechanism according to claim 1, wherein the first distance is between 1/16–3/16 in. (1.6–4.8 mm).

10. A resealable closure mechanism according to claim 1, wherein the first and second closure profiles comprise a polymeric material.

11. A resealable closure mechanism according to claim 10, wherein the first and second closure profiles comprise polypropylene or polyethylene.

12. A resealable package comprising:

(a) first and second panel sections joined together to define an enclosed region; first and second opposite side edges; a top edge; and a mouth providing access to the enclosed region; and (b) a closure arrangement for selectively opening and sealing the mouth; the closure arrangement having a slider-parking section extending from the first side edge over a first distance, and a matable section extending between the slider-parking section and the second side edge; the closure arrangement including:

(i) a first closure profile secured to the first panel section; the first closure profile including a first base strip and a first interlocking closure member;

(ii) a second closure profile secured to the second panel section; the second closure profile including a second base strip and a second interlocking closure member;

(A) the first and second interlocking closure members in the matable section each extending a first length from respective first and second base strips sufficient to selectively engage; and (B) the first and second interlocking closure members in the slider-parking section being truncated relative to the first length; and (iii) a slider having a plow, a second length, and first and second walls forming a first cavity for receiving the top edge; the second length being greater than the first distance of the slider-parking section; the slider being arranged and configured to:

(A) slide along the top edge in a first direction to cause the first and second closure profiles to engage in the matable section;

(B) slide along the top edge in a second direction to cause the first and second closure profiles to disengage in the matable section; and (C) rest in the slider-parking section against the first side edge to seal the mouth.

13. A method of manufacturing a resealable package having first and second opposing panels, the method comprising:

(a) placing the first panel adjacent to the second panel;

(b) sealing a plurality of edges of the first panel to corresponding edges of the second panel;

(c) placing a resealable closure mechanism between an unsealed edge of the first panel and a corresponding unsealed edge of the second panel, the resealable closure mechanism extending between a first side edge of the package and a second side edge of the package; the resealable closure mechanism including:

(i) a slider-parking section extending from the first side edge of the package over a first distance, and a matable section extending between the slider-parking section and the second side edge of the package;

(ii) a first closure profile including a first base strip and a first interlocking closure member;

(iii) a second closure profile including a second base strip and a second interlocking closure member;

(A) the first and second interlocking closure members in the matable section each extending a first length from respective first and second base strips sufficient to selectively engage; and (B) the first and second interlocking closure members in the slider-parking section being truncated relative to the first length to prevent engagement; and (iv) a slider having a plow, a second length, and first and second walls forming a first cavity for receiving a package edge; the second length being greater than the first distance of the slider-parking section; the slider being arranged and configured to:

(A) slide along a package edge in a first direction to cause the first and second closure profiles to engage in the matable section;

(B) slide along the package edge in a second direction to cause the first and second closure profiles to disengage in the matable section; and (C) rest in the slider-parking section; and (d) securing the resealable closure mechanism to the first and second panels.

14. A method of manufacturing a resealable package according to claim 13, wherein the step of securing includes securing the first closure profile to the first panel, and securing the second closure profile to the second panel.

15. A method of manufacturing a resealable package according to claim 14, wherein:

(a) the step securing the first closure profile to the first panel includes bonding the first closure profile to the first panel with a first sealant layer; and (b) the step of securing the second closure profile to the second panel includes bonding the second closure profile to the second panel with a second sealant layer.

16. A method of sealing a resealable package comprising:

(a) providing a package having first and second opposite side edges; a resealable mouth between the first and second side edges; and a zipper closure with a slider thereover for opening and resealing the mouth; the zipper closure including first and second opposed selectively interlocking profiles;

(b) moving the slider along the mouth from the second edge to interlock the first and second profiles until reaching a distance from the first edge less than a length of the slider; and (c) moving the slider snugly against the first edge without interlocking the first and second profiles to seal the mouth.

17. A method of sealing a resealable package according to claim 16, wherein the step of moving the slider along the mouth includes moving the slider to a distance 1/8 inches (3.2 mm) from the first edge.

* * * * *